United States Patent [19]

Harris et al.

[11] 4,197,923

[45] Apr. 15, 1980

[54] ACOUSTICAL CEILING BAFFLE

[75] Inventors: David A. Harris, Sylvania; James E. Jones, Toledo, both of Ohio

[73] Assignee: Owens-Corning Fiberglas Corporation, Toledo, Ohio

[21] Appl. No.: 963,702

[22] Filed: Nov. 27, 1978

[51] Int. Cl.[2] ..... E04B 5/52

[52] U.S. Cl. ..... 181/287; 181/291; 181/295; 52/144

[58] Field of Search ..... 181/30, 284, 286, 287, 181/290, 291, 295, 199; 160/84 R, 84 V, 84 H, 135, 231 A; 49/409-411; 52/144, 145

[56] References Cited

U.S. PATENT DOCUMENTS

| | | | |
|---|---|---|---|
| 2,704,865 | 3/1955 | Slering | 181/295 |
| 2,882,990 | 4/1959 | Mustoe | 181/295 |
| 2,994,112 | 8/1961 | Stephens | 181/295 |
| 3,159,235 | 12/1964 | Young et al. | 181/286 |
| 3,160,226 | 12/1964 | Jack et al. | 181/295 |
| 3,857,459 | 12/1974 | Adams et al. | 181/295 |

*Primary Examiner*—John Gonzales
*Assistant Examiner*—Benjamin R. Fuller
*Attorney, Agent, or Firm*—Ronald C. Hudgens; Philip R. Cloutier; Paul J. Rose

[57] ABSTRACT

A fibrous glass board is longitudinally grooved on one side adjacent the center for folding. The folded board is provided with a pair of plastic end caps respectively on opposite ends. The exposed surfaces of the folded board are provided with a decorative facing material, preferably glass cloth. Means are provided for suspending the completed baffle by the end caps from a gridwork of inverted T-bars.

4 Claims, 9 Drawing Figures

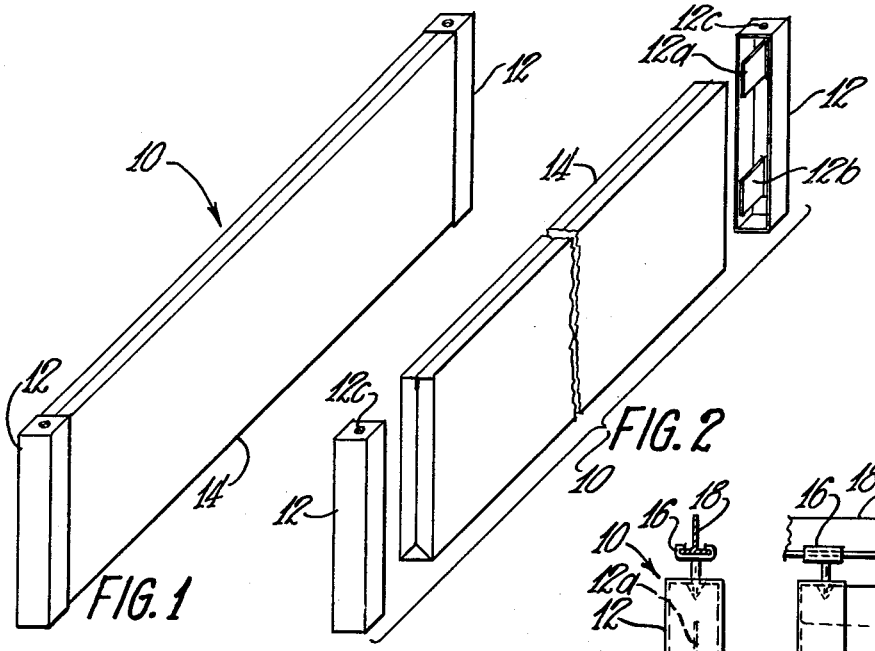
FIG. 1
FIG. 2
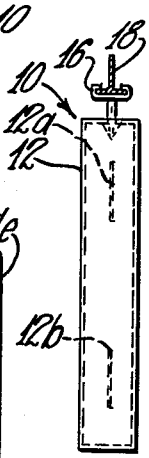
FIG. 3
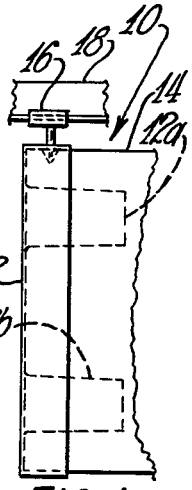
FIG. 4
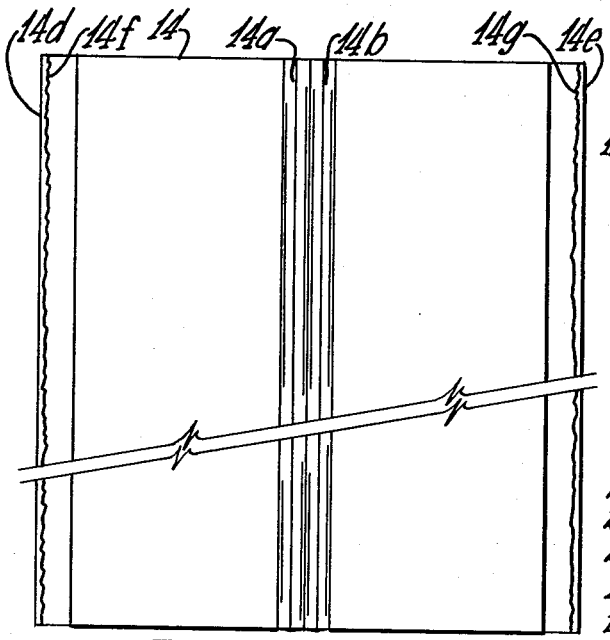
FIG. 5
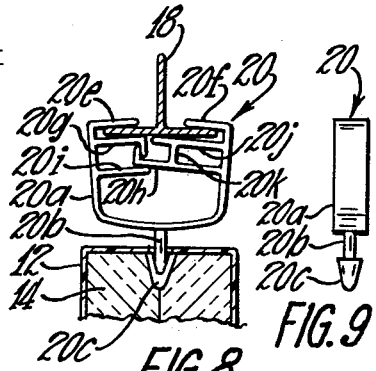
FIG. 8
FIG. 9
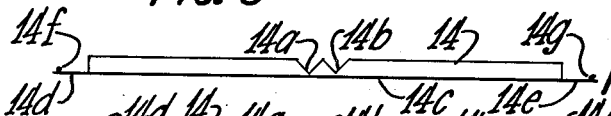
FIG. 6
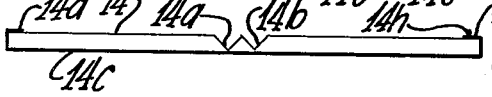
FIG. 7

ACOUSTICAL CEILING BAFFLE

This invention relates generally to acoustical ceiling baffles suspended from ceilings to dispose major surfaces thereof in vertical planes, and more particularly to an improved construction of such a baffle.

An object of the invention is to provide an improved acoustical ceiling baffle and method of making it.

Other objects will become apparent when the following specification is considered along with the accompanying drawings in which:

FIG. 1 is a a perspective view of an acoustical ceiling baffle constructed in accordance with the invention;

FIG. 2 is an exploded perspective view of the baffle of FIG. 1, but showing a preferred form of end cap as the invention of another;

FIG. 3 is an end view, partially in section, of the baffle of FIG. 1 suspended from an inverted T-bar by suspension means invented by another;

FIG. 4 is a fragmentary side view of the baffle of FIG. 1 suspended from an inverted T-bar;

FIG. 5 is a top plan view of a grooved fibrous glass board forming a part of the baffle of FIG. 1;

FIG. 6 is an end view of the grooved board of FIG. 5 with facing material on the bottom;

FIG. 7 is a view similar to FIG. 6, but with flaps of the facing material wrapped around the opposite edge portions of the board;

FIG. 8 is a view similar to FIG. 3, but showing a prefered form of suspension clips as the invention of another; and FIG. 9 is an elevational view of the suspension clip of FIG. 8, taken from the right-hand side of FIG. 8.

With respect to the drawings, FIGS. 1 to 4 show an improved acoustical ceiling baffle 10 constructed in accordance with the invention. The baffle 10 includes a pair of molded plastic end caps 12 and a grooved and folded, glass cloth faced, fibrous glass board 14.

In a preferred form claimed in the copending application of Merritt W. Seymour, Barry R. Wyerman and Gary R. Steffy, Ser. No. 973,310, filed Dec. 26, 1978, and entitled "End Cap And Suspension Means For Acoustical Ceiling Baffle", each of the end caps 12 is provided with a pair of upper and lower blade portions 12*a* and 12*b* extending from an inner side of an end wall portion thereof, as shown on the upper end cap 12 in FIG. 2 and shown in truer proportion in FIG. 4. Further, an upper wall portion of each end cap 12 has an aperture 12*c* for receiving a barb portion of a suspension clip 16 attachable to the inverted T-bars 18 of a ceiling grid for mounting acoustical ceiling panels (not shown). FIG. 8 shows a suspension clip 20 which is the preferred form and includes a generally U-shaped body portion 20*a* and a depending rod portion 20*b* having a barb portion 20*c* on a lower end portion thereof. Each leg portion of the body portion 20*a* has three inwardly extending cantilever portions the opposite upper ones 20*e* and 20*f* of which extend over the head of the inverted T-bar 18 when the suspension clip 20 is mounted thereon. An intermediate L-shaped cantilever portion 20*g* disposed below the cantilever portion 20*e* and having a downwardly extending leg portion interlocks with a lower L-shaped cantilever portion 20*h* disposed below the cantilever portion 20*f* and having an upwardly extending leg portion. A lower cantilever portion 20*i* disposed below the cantilever portion 20*g* aids in retaining the cantilever portions 20*g* and 20*h* in interlocked relationship. An intermediate stiffening cantilever portion 20*j* is connected to the cantilever portion 20*h* by a web 20*k*.

FIGS. 5 and 6 show the fibrous glass board 14 before it is folded. A facing material 14*c*, preferably woven glass cloth, is adhered to one side of the board by a suitable adhesive. The facing material 14*c* includes flaps 14*d* and 14*e* respectively extending transversely beyond the longitudinal edges of the board 14. The board 14 is provided with longitudinal generally V-shaped grooves 14*a* and 14*b* on the unfaced side adjacent the transverse center. The sides of each of the grooves are substantially ninety degrees apart and each side forms about a forty-five degree angle with the general plane of the board.

In the forming of the baffle 10, after the grooves 14*a* and 14*b* are cut by a grooving machine, strips of glue 14*f* and 14*g* are deposited respectively on the inner side of the flaps 14*d* and 14*e* longitudinally along their outermost edges and the flaps are wrapped respectively around the edge portions of the boards as shown in FIG. 7. Thereafter another strip of glue 14*h* is deposited longitudinally along one of the flaps 14*d* and 14*e* on the outer side thereof, as shown on the flap 14*e* in FIG. 7. The board 14 is then folded together as shown in FIG. 2 and the end caps 12 pressed into place, the blade portions 12*a* and 12*b* extending between the two thicknesses of the board. Preferably glue is first applied to the inside of the end wall portion of each end cap.

Various modifications may be made in the structure shown and described without departing from the spirit and scope of the invention.

We claim:

1. An acoustical ceiling baffle comprising an elongate fabricated fibrous board longitudinally grooved on one side with a pair of grooves, faced with a decorative facing material on the other side, and folded at the grooves to provide a double thickness of the board with the facing material on the outside, and a pair of end caps respectively enclosing opposite end portions of the folded board and each having provision on an upper wall portion thereof for suspending the baffle.

2. A ceiling baffle as claimed in claim 1 wherein the board is fibrous glass.

3. A ceiling baffle as claimed in claim 1 wherein the facing is woven glass cloth.

4. A ceiling baffle as claimed in claim 1 wherein the facing material has flaps originally extending transversely beyond opposite longitudinal edges of the unfolded board and the flaps are wrapped around the edge portions of the board and extend into the fold of the folded board.

* * * * *